US006550818B2

(12) United States Patent
Robin

(10) Patent No.: US 6,550,818 B2
(45) Date of Patent: Apr. 22, 2003

(54) BENT SUB ASSEMBLY FOR DIRECTIONAL DRILLING

(75) Inventor: Lawrence E. Robin, Edmonton (CA)

(73) Assignee: Cavare Ltd., Edmonton (CA)

( * ) Notice: Subject to any disclaimer, the term of this patent is extended or adjusted under 35 U.S.C. 154(b) by 0 days.

(21) Appl. No.: 09/839,516

(22) Filed: Apr. 20, 2001

(65) Prior Publication Data

US 2002/0153723 A1 Oct. 24, 2002

(51) Int. Cl.[7] ..... F16L 27/00
(52) U.S. Cl. ..... 285/184; 175/74
(58) Field of Search ..... 285/184, 333, 285/334; 175/74, 73

(56) References Cited

U.S. PATENT DOCUMENTS

| | | | |
|---|---|---|---|
| 4,077,657 A | 3/1978 | Trzeciak | |
| 4,303,135 A | 12/1981 | Benoit | |
| 4,745,982 A | 5/1988 | Wenzel | |
| 4,813,497 A | 3/1989 | Wenzel | |
| 5,052,501 A | 10/1991 | Wenzel | |
| 5,094,305 A | 3/1992 | Wenzel | |
| 5,101,915 A | 4/1992 | Witte | |
| 5,248,004 A | 9/1993 | Witte | |
| 5,343,966 A | 9/1994 | Wenzel | |
| 5,474,334 A | * 12/1995 | Eppink | 285/184 |
| 5,495,901 A | 3/1996 | Livingstone | |

FOREIGN PATENT DOCUMENTS

| | | |
|---|---|---|
| CA | 2045036 | 1/1992 |
| CA | 2025653 | 3/1992 |
| CA | 2045888 | 12/1992 |
| CA | 2072517 | 12/1992 |
| CA | 2270109 | 11/2000 |

* cited by examiner

*Primary Examiner*—Lynne H. Browne
*Assistant Examiner*—Giovanna M Collins
(74) *Attorney, Agent, or Firm*—Dennis T. Griggs

(57) ABSTRACT

An adjustable bent sub assembly is provided comprising a tubular adaptor for connection with the stator of a downhole motor, a tubular adjusting ring for altering the angular offset of the assembly, and a tubular offset sub for connection with the bearing and bit assemblies. A tubular mandrel is positioned internal of this stack of components. The mandrel is threadably connected at its upper end with the adaptor and at its lower end with the offset sub. The mandrel and ring have a spline connection. The ring and offset sub have disengagable dog clutch means connection them. The mandrel is transversely bent at a point along its length as is the offset sub. The ring has an angled or canted bottom end face. The combination of bending the internal mandrel, bending the offset sub and canting the end face of the ring results in the effective or resultant bend point of the assembly being closer to its lower end.

2 Claims, 6 Drawing Sheets

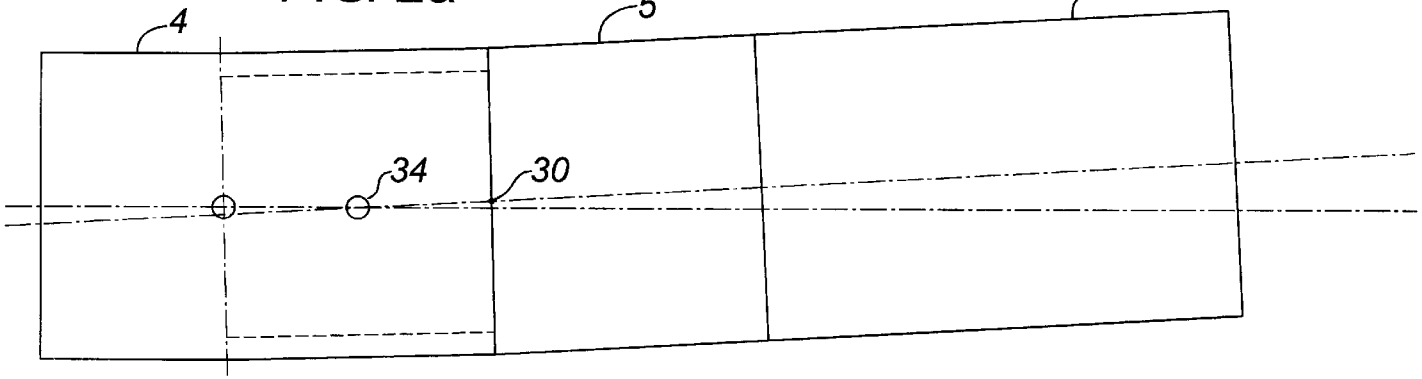
FIG. 2a
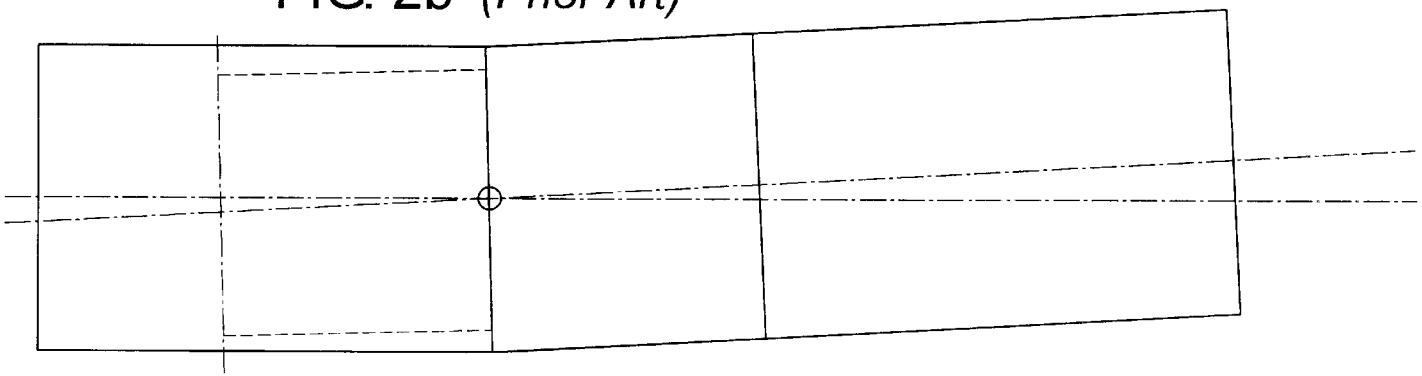
FIG. 2b *(Prior Art)*

BENT SUB ASSEMBLY FOR DIRECTIONAL DRILLING

FIELD OF THE INVENTION

The present invention relates to a bent sub assembly for use in directional drilling.

BACKGROUND OF THE INVENTION

Bent sub assemblies are used to change the direction in which a drilling bit cuts the borehole. The bent sub assembly has a transverse bend at a point along its length. The assembly is commonly positioned between the power section of a downhole motor and a bearing assembly to which the bit is connected. At its upper end, the bent sub assembly is coaxial with the longitudinal axis of the power section and the drill string, but beneath the bend the longitudinal axis of the lower end of the bent sub assembly and the bearing assembly attached thereto is offset at a slight angle (typically up to 3°).

It is known to those skilled in the art that it is desirable to locate the bend of the bent sub assembly as close to the bit as possible. Every inch counts. The distance of the bend from the bit will affect the "aggressiveness" and control of the drilling assembly. If the bend is closer to the bit, the drilling assembly will "build angle" or change direction more quickly than it will if the bend is further from the bit.

It is the purpose of the present invention to provide a bent sub assembly having an effective or resultant bend point which is close to the lower end of the assembly, and thus to the bit.

SUMMARY OF THE INVENTION

In accordance with the invention an adjustable, tubular bent sub assembly is provided having two bends at spaced points along its length, so that the assembly has a resultant or effective bend point close to its lower end. The bent sub assembly has longitudinal axes of symmetry at its upper and lower ends which are angularly offset. The assembly further has means for adjusting the extent of the angular offset.

More particularly, in a preferred embodiment, the tubular bent sub assembly comprises:

an internal mandrel which is threadably connected at its upper and lower ends with an external adaptor and an external offset sub, respectively, the mandrel further being disengagably locked by splines or the like with an external adjusting ring positioned between the adaptor and the offset sub, the lower end of the adjusting ring being connected with the upper end of the offset sub by axially disengagable clutch means, so that the assembled components form a solid unit for transmitting rotation from a power unit or downhole motor assembly to a drill bit assembly;

the offset sub is positioned at the base of the assembly and has a transverse bend at a point along its length, thereby defining upper and lower sub sections above and below the bend, each sub section having a longitudinal axis of symmetry, the axis of the upper sub section being perpendicular to the plane of the upper end face of the offset sub, the offset sub being symmetrically internally threaded at its upper end for connection with the mandrel (that is, the threads are coaxial with the upper sub section);

the mandrel is externally threaded at each end and has a transverse bend at a point along its length, close to or at the interface of the offset sub and the adjusting ring, the bend therefore defining upper and lower mandrel sections above and below the bend, each mandrel section having a longitudinal axis of symmetry, the axis of the upper mandrel section being coaxial with the adaptor and the axis of the lower mandrel section being coaxial with the upper sub section, the mandrel having external splines extending longitudinally thereof above its bend point;

the tubular adaptor is straight and has a longitudinal axis which is coaxial with the axis of the mandrel upper section—the adaptor is internally threaded at its lower end for connection with the mandrel and is threaded at its upper end for connection with the stator of the power section;

the tubular adjusting ring is straight and has a canted bottom end face that butts up flush to the upper end face of the offset sub. The adjusting ring further has internal, longitudinally extending splines for engaging the mandrel splines to lock the ring and mandrel together for rotation while allowing the ring to be moved axially along the mandrel when the ring is not restrained at its upper end—the ring is adapted to turn with the mandrel about the lower axis of the mandrel, which is coaxial with the axis of the upper section of the offset sub. As a result, the lower end face of the ring remains parallel with the upper end face of the offset sub, so as to butt flush therewith, and the upper axis of the mandrel changes orientation relative to the lower axis of the offset sub when rotated.

By the combination of bending the mandrel at the interface of the ring and the offset sub, bending the offset sub below that interface and canting the lower end face of the ring and the upper end face of the offset sub, one can locate the effective bend point of the bent sub assembly beneath the ring (that is, within the upper sub section of the offset sub). In addition, by locating the second bend in the offset sub, this has made it possible to cut the top thread of the offset sub concentrically, instead of angling it as has been common with prior art bent sub assemblies. As a result, the section modulus remains constant through the cross-section of the upper end of the offset sub, thereby avoiding weakening it as has been the case in the prior art.

Broadly stated, there is provided a bent sub assembly for directional drilling, comprising an external tubular adaptor having an internally threaded lower end; an internal tubular mandrel having externally threaded ends and being transversely bent at a point along its length to define upper and lower mandrel sections having angularly offset axes of symmetry, the upper mandrel section being received in the adaptor lower end and being threadably connected therewith; an external tubular offset sub transversely bent at a point along its length to define upper and lower sub sections having angularly offset axes of symmetry, the upper sub section being internally threaded at its upper end and coaxially receiving the lower mandrel section and being threadably connected therewith, the offset sub having an upper end face perpendicular to the axis of symmetry of the upper sub section; an external tubular adjusting ring having an axis of symmetry and being positioned between and abutting the adaptor and the offset sub, the ring being slidably splined with the mandrel, the ring having a lower end face canted at an angle to the axis of symmetry of the ring; the offset sub upper end face and the ring lower end face being disposed to butt flush against each other when assembled; the combination, of bending the internal mandrel, bending the offset sub and canting the lower end face of the ring, resulting in locating the effective bend point of the bent sub assembly beneath the ring.

DESCRIPTION OF THE DRAWINGS

FIGS. 2*a* and 2*b* are comparative simplified schematic side views of a bent sub in accordance with the present invention and in accordance with conventional design, showing the locations of the bend centers for the two units;

DESCRIPTION OF THE PREFERRED EMBODIMENT

Figure 1:
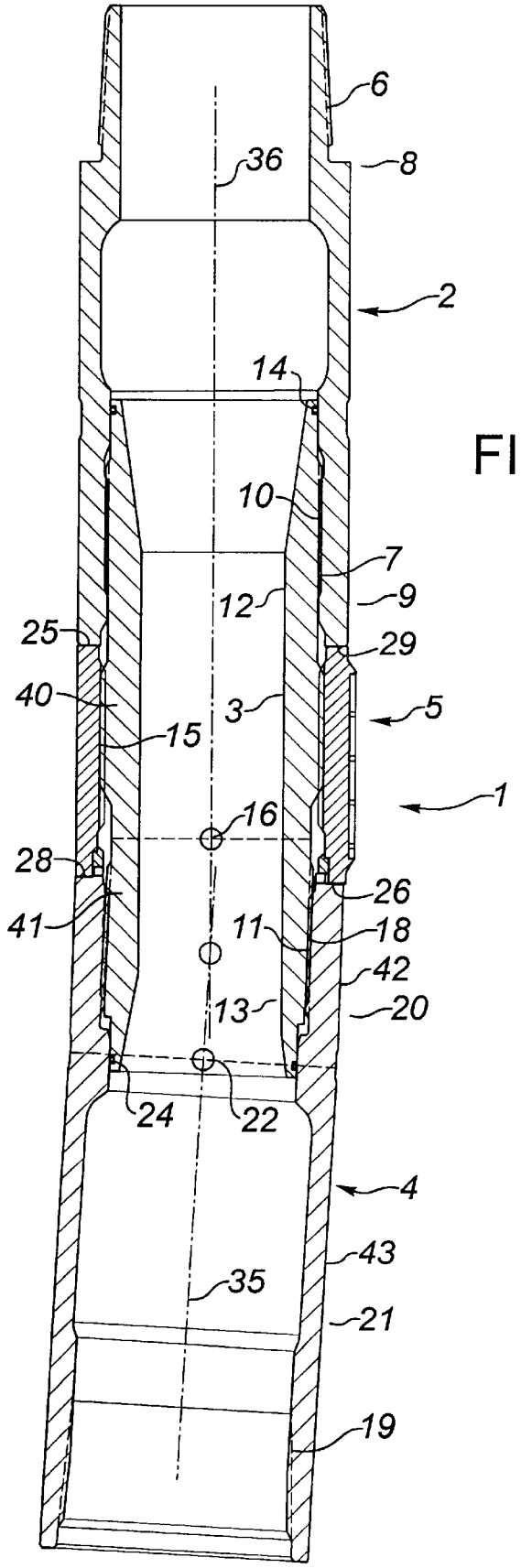
FIG. 1 is a cross-sectional side view of a bent sub assembly in accordance with the invention.

The bent sub 1 comprises a stator housing adaptor 2, a mandrel 3, an offset sub 4 and an adjusting ring 5. Each of these parts are tubular in nature.

The adaptor 2 has external and internal threads 6, 7 at its upper and lower ends 8, 9, respectively. It threadably and squarely connects at its upper end with the stator (not shown) of the downhole motor (also not shown). The adaptor 2 is coaxial with the drilling motor and the drill string above it.

The mandrel 3 has external threads 10, 11 at its upper and lower ends 12, 13 respectively. The upper end 12 of the mandrel 3 is threadably connected with the lower end of the adaptor 2. An O-ring 14 seals the mandrel 3 with the adaptor 2. Between its ends, the mandrel 3 forms splines 15. The mandrel 3 is transversely bent, typically 1.5°, at the bend center 16 to define upper and lower mandrel sections 40, 41.

The offset sub 4 has internal threads 18, 19 at its upper and lower ends 20, 21 respectively. The upper end 20 is threadably connected with the mandrel lower end 13. The offset sub 4 is bent, typically 1.5°, at the bend center 22 to define upper and lower offset sub sections 42, 43.

The mandrel 3 is sealed to the offset sub 4 by the O-ring 24.

The adjustment ring 5 is positioned between and abuts the lower end face 25 of the adaptor 2 and the upper end face 26 of the offset sub 4. The ring 5 forms internal splines 27 which can slide axially between the splines 15 of the mandrel 3. The ring 5 is thus capable of being moved axially when the adaptor 2 is displaced upwardly but is locked against rotation with respect to the mandrel 3 when the splines 15, 27 are engaged.

The lower end face 28 of the ring 5 is canted 1.5° relative to its upper end face 29 or to its axis of symmetry. The upper end face 26 of the offset sub 4 butts flush with the ring lower end face 28.

The ring lower end face 28 and the offset sub upper end face 26 are formed to provide alternating dogs 31 and slots 32 (hereinafter referred to as 'dog clutch means'), which engage to lock the ring 5 and offset sub 4 for rotation together.

Figure 3:
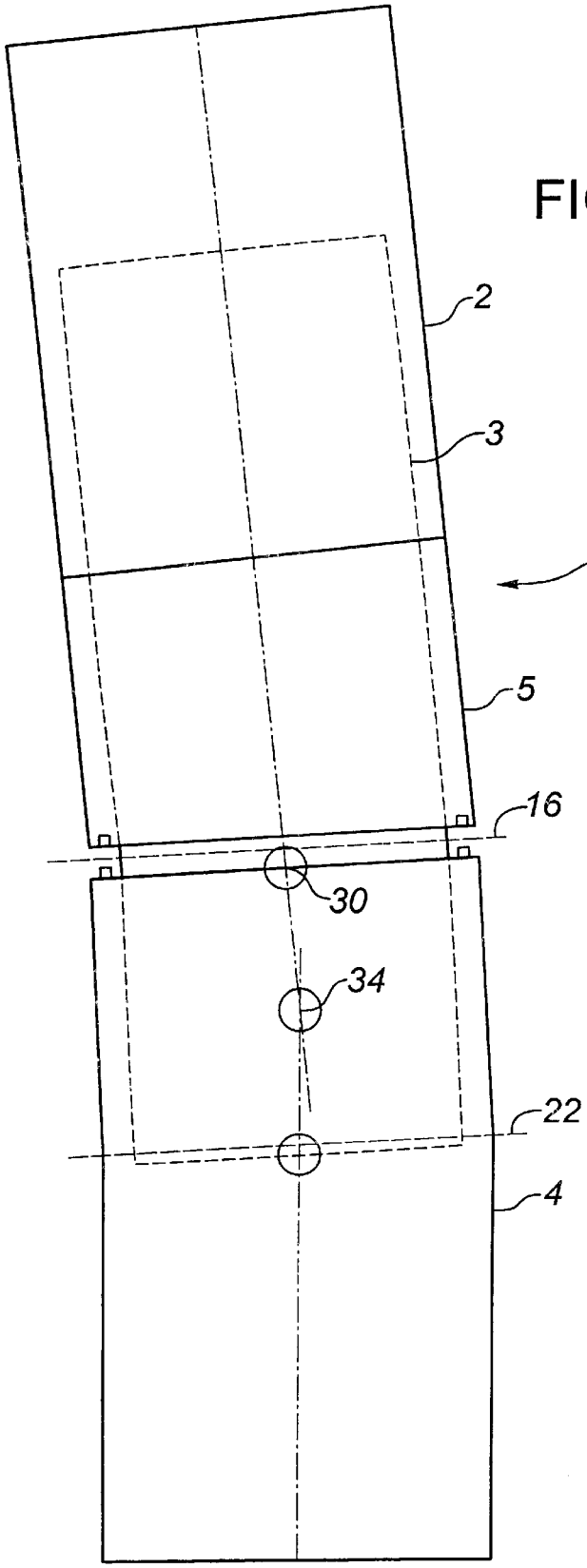
FIG. 3 is a simplified side view showing the two bends of the assembly in conjunction with the canted end faces of the adjusting ring and offset sub.
Figure 4:
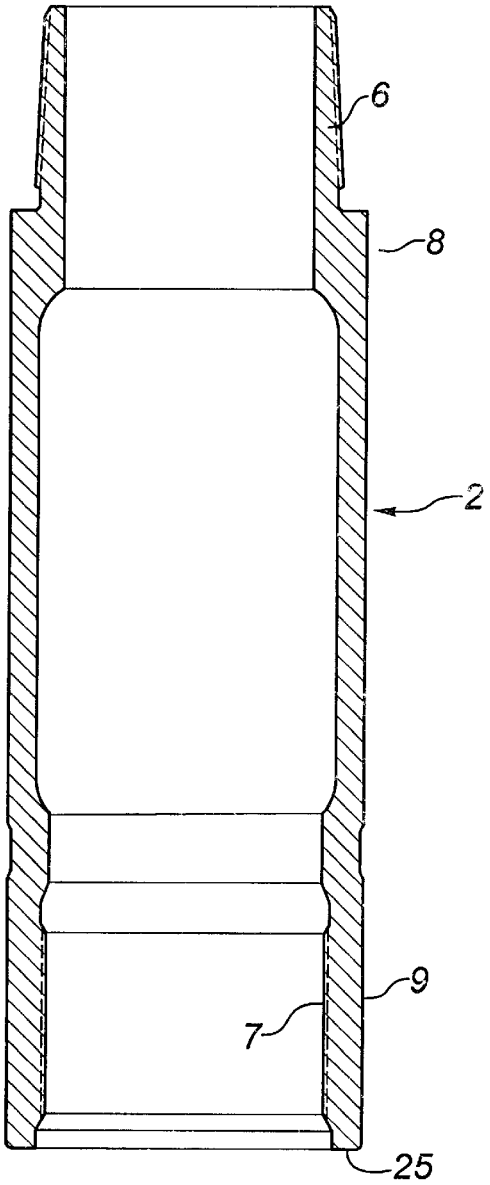
FIG. 4 is a cross-sectional side view of the stator housing adaptor of the bent sub assembly.
Figure 5:
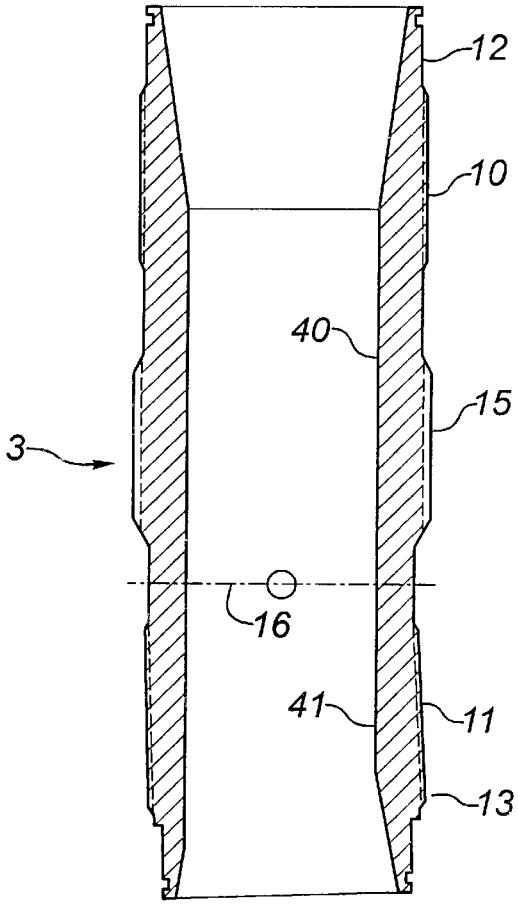
FIG. 5 is a cross-sectional side view of the bent mandrel of the bent sub assembly.
Figure 6:
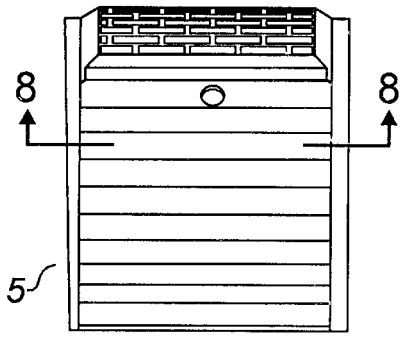
FIG. 6 is a side view of the adjusting ring of the bent sub assembly.
Figure 7:
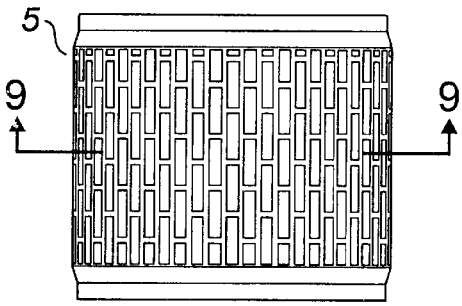
FIG. 7 is another side external view of the adjusting ring.
Figure 8:
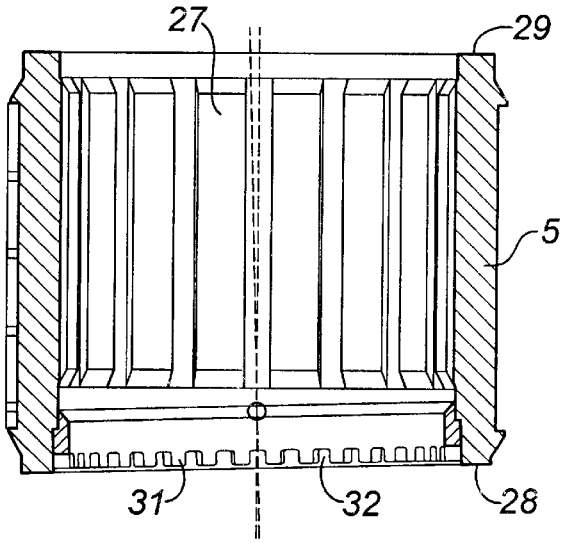
FIG. 8 is a cross-sectional view of the adjusting ring.
Figure 9:
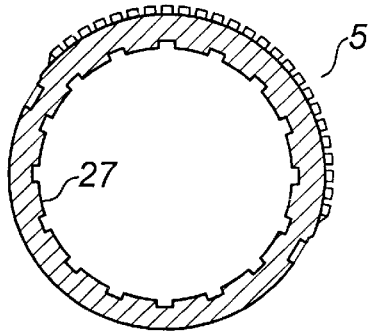
FIG. 9 is a cross-sectional view of the adjusting ring taken along the line A—A of FIG. 7.
Figure 10:
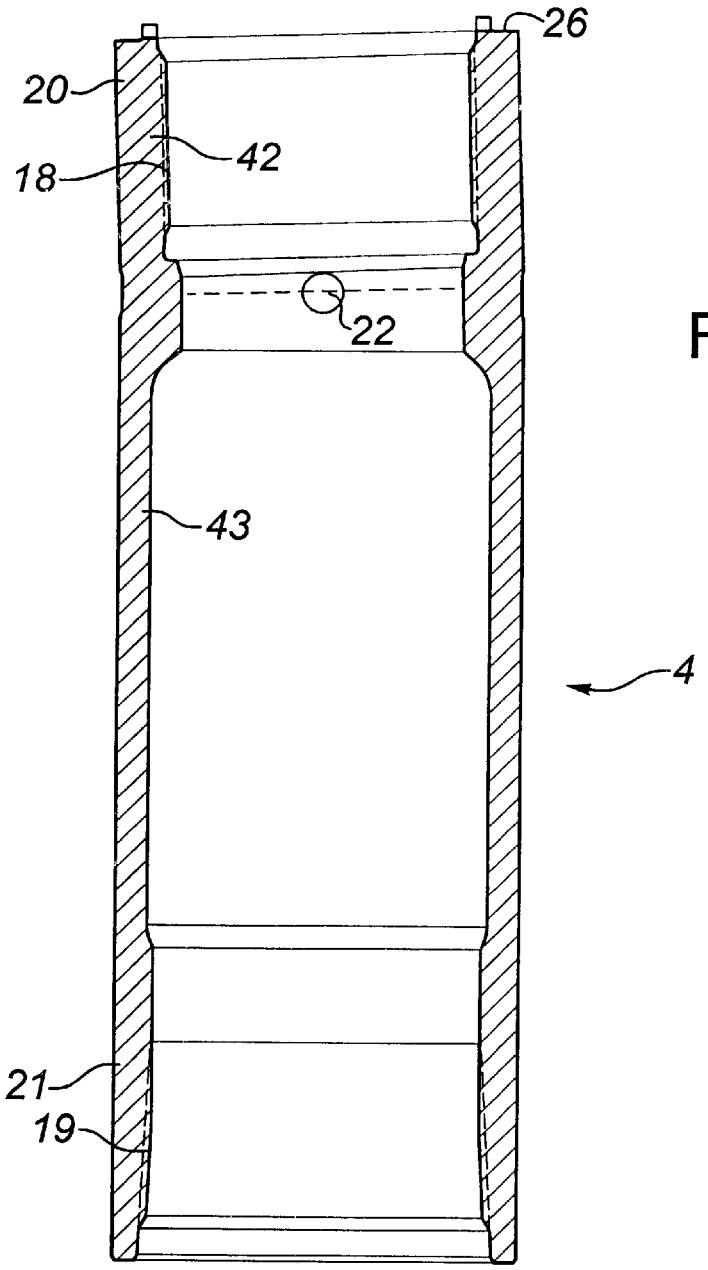
FIG. 10 is a cross-sectional side view of the offset sub of the bent sub assembly.
Figure 11:
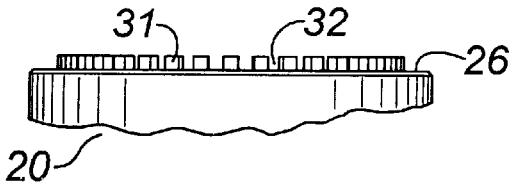
FIG. 11 is a fragmentary side view showing the top end of the offset sub.

Having reference to FIG. 3, it will be noted that the resultant 3° bend center 34 of the assembled bent sub 1, provided with 1.5° bends at the two bend centers 22, 30, is spaced below the ring end face 28.

To adjust the extent of offset of the axis 35 of the lower offset sub section 43 relative to the axis 36 of the adaptor 2 one can follow the following procedure:

- the offset sub 4 is rotationally fixed by applying chain tongs to it;
- at this stage, the adjusting ring 5 is also rotationally fixed because the dogs 31 and slots 32 of the dog clutch means are engaged;
- a second set of chain tongs is applied to the adaptor 2 to back off the threaded connection between the lower threads 7 of the adaptor 2 and the upper threads 10 of the mandrel 3—as the adaptor 2 moves upwardly as a result, a clearance develops between the adaptor lower end 9 and the ring upper end face 29;
- the tongs are then moved from the adaptor 2 to the ring 5 and the ring is lifted so that the dogs 31 and slots 32 of the dog clutch means disengage—however the mandrel and ring splines 15, 27 are still engaged so that the mandrel 3 and ring 5 will turn together;
- the tongs on the ring are then turned to rotate the ring 5 to a new setting;
- the ring 5 is then lowered to re-engage the dogs 31 and slots 32 and the adaptor 2 is then turned to lower it to abut the ring 5.

The embodiments of the invention in which an exclusive property or privilege is claimed are defined as follows:

1. A bent sub assembly for directional drilling, comprising:

- an external tubular adaptor having an internally threaded lower end;
- an internal tubular mandrel having externally threaded ends and being transversely bent at a point along its length to define upper and lower mandrel sections having angularly offset axes of symmetry, the upper mandrel section being received in the adaptor lower end and being threadably connected therewith;
- an external tubular offset sub transversely bent at a point along its length to define upper and lower sub sections having angularly offset axes of symmetry, the upper sub section being internally threaded at its upper end and coaxially receiving the lower mandrel section and being threadably connected therewith, the offset sub having an upper end face perpendicular to the axis of symmetry of the upper sub section;

an external tubular adjusting ring having an axis of symmetry and being positioned between and abutting the adaptor and the offset sub, the ring being slidably splined with the mandrel, the ring having a lower end face canted at an angle to the axis of symmetry of the ring;

the offset sub upper end face and the ring lower end face being disposed to butt flush against each other when assembled;

the combination, of bending the internal mandrel, bending the offset sub and canting the lower end face of the ring, resulting in locating the resultant bend point of the bent sub assembly beneath the ring.

2. The bent sub assembly as set forth in claim 1 wherein:

the ring and offset sub have clutch means for disengagably locking them together for rotation, the ring being rotationally adjustable when the clutch means are disengaged to alter the degree of angularity of the bent sub assembly.

* * * * *